US005611539A

United States Patent [19]

Watterson et al.

[11] Patent Number: 5,611,539

[45] Date of Patent: Mar. 18, 1997

[54] POLE SPORT COURT

[75] Inventors: Scott R. Watterson; William C. Lay, both of Logan, Utah; John Frodsham, Mexico City, Mexico; John C. Heath; William T. Dalebout, both of Logan, Utah

[73] Assignee: Icon Health & Fitness, Inc., Logan, Utah

[21] Appl. No.: 382,340

[22] Filed: Feb. 1, 1995

[51] Int. Cl.[6] ..... A63B 61/02; A63B 63/04; A63B 69/00

[52] U.S. Cl. ..... 473/197; 273/400; 473/147; 473/416; 473/428; 473/429; 473/430; 473/446; 473/473; 473/474; 473/494

[58] Field of Search ..... 273/411, 26 E, 273/26 EA, 29 B, 29 BB, 58 C, 413, 414; 473/147, 197

[56] References Cited

U.S. PATENT DOCUMENTS

| | | | |
|---|---|---|---|
| 1,224,387 | 5/1917 | Lane | 273/29 BB |
| 1,224,410 | 5/1917 | Porte | 273/182 R |
| 1,902,412 | 5/1933 | Zimmer | 273/200 A |
| 2,680,022 | 6/1954 | Walden | 273/26 EA |
| 3,086,775 | 4/1963 | Albert | 273/26 EA |
| 3,271,030 | 9/1966 | Mueller | 273/26 E |
| 3,934,873 | 1/1976 | Griffin | 273/26 E |
| 4,093,224 | 6/1978 | Hale | 273/411 |
| 4,135,716 | 1/1979 | Ginsburg | 273/411 X |
| 4,147,353 | 4/1979 | Moore | 273/413 |
| 4,720,112 | 1/1988 | Stettner et al. | 273/411 |
| 4,883,272 | 11/1989 | Lay | 273/26 A |
| 4,948,149 | 8/1990 | Lin et al. | 273/411 |
| 5,083,797 | 1/1992 | Vartija et al. | 273/414 |
| 5,238,251 | 8/1993 | Staka | 273/413 X |
| 5,269,533 | 12/1993 | Kellams | 273/411 |
| 5,271,616 | 12/1993 | Grimaldi | 273/26 A |
| 5,271,618 | 12/1993 | Malwitz | 273/26 E |
| 5,303,932 | 4/1994 | Kessler | 273/411 |
| 5,393,069 | 2/1995 | Taylor | 273/411 |
| 5,419,550 | 5/1995 | Blom | 273/26 E |

FOREIGN PATENT DOCUMENTS

| | | | |
|---|---|---|---|
| 2165956 | 7/1973 | Germany | 273/414 |

*Primary Examiner*—William H. Grieb
*Attorney, Agent, or Firm*—Trask, Britt & Rossa

[57] ABSTRACT

A game system includes two uprights formed of three telescoping sections. The lower section extends into a base which is positioned into the supporting surface or related ground. A plurality of securing structures are positioned along the length of each upright to receive a net. The net has at least two elastically-deformable straps extending away therefrom for securing the net to the uprights for use at least two sports. Alternate game structure may be secured to the upright, including a tetherball, a soccer ball, a soccer net, a golf ball receiving net, and a baseball practice structure. Also, net-securing structure may be secured to one of the uprights to receive a net for storage.

54 Claims, 6 Drawing Sheets

POLE SPORT COURT

BACKGROUND OF THE INVENTION

1. Field of the Invention

This invention relates to apparatus that may be configured and reconfigured for playing or practicing at different games. More specifically the invention includes apparatus that may be configured or assembled for practicing or playing two or more of men's volleyball, women's volleyball, soccer, golf, baseball, tetherball, badminton, lawn tennis and the like.

2. State of the Art

Structures to support nets for playing men's volleyball, women's volleyball, badminton and other outdoor ball sports are known. That is, apparatus for playing one of the above-identified sports or games are believed to be widely available for purchase and for placement or installation in, for example, a backyard or playground area.

Some devices are portable such as the one shown in U.S. Pat. No. 5,238,251. U.S. Pat. No. 5,303,932 illustrates another game apparatus of the type suitable for playing a volleyball-type game.

Backyard badminton sets may be purchased in which portable poles may be positioned to support a net in between. Portable soccer goals are known as well as portable nets into which one may hit a golf ball for purposes of practice or exercise.

Structures in which the game nets or game apparatus may be adjusted or positioned for purposes of playing different games are desirable in order to provide greater flexibility with minimum cost.

A game system has two spaced apart uprights with net serving structures associated with each and spaced apart under the length thereof. A game net is attachable to the net securing structure for use in playing two or more games or sports.

SUMMARY OF THE CLAIMS

A game system has two spaced apart uprights with a net. The uprights have a plurality of net-securing structures therealong. The net has attaching structure to connect to select net-securing structures to position the net in different locations for use in performing different games or sports.

Another game system includes a first base and a spaced apart second base each secured to a supporting surface. The bases are spaced apart a preselected distance preferably consistent with the needs of the game to be played.

The first upright is removably secured to the first base to extend upwardly therefrom. The first upright has a length with a plurality of net-securing structures associated therewith. The net-securing structures are spaced apart along the length of the upright. The second upright is removably secured to the second base to extend upwardly therefrom. The second upright has a length and also has a plurality of net-securing structures associated therewith and spaced apart along the length thereof.

The game system also includes a game net having right securing means for connection to a first selected of said plurality of net-securing structures of the first upright for use as a net in a first game and to a second selected of the plurality of net-securing structures of the first upright at a second position along the length thereof for use as a net in a second game. The game net also has left securing means for connection to a first selected of the plurality of net-securing structures of the second upright at a first position along the length thereof for use as a net in a first game. The left securing means may also be connected to a second selected of the plurality of the net-securing structures of the second upright at a second position along the length of the second upright for use as a net in the second game.

The first base and the second base each desirably include a receptacle sized to snugly and removably receive the first upright and the second upright respectively. The first base also preferably has a flange attached to the first receptacle with means associated with the first flange to attach or secure the first flange to a support surface. Similarly, the second base has a flange attached to the second receptacle and preferably includes means for securing or attaching the second flange to a support surface.

The first receptacle may preferably be positioned into or under the support surface such as the ground with the flange being positioned at or near the top or along the surface of the ground. A plurality of apertures may be formed in the flange to receive removable spikes or stakes to secure the flange by positioning the spikes or stakes through the apertures into the ground. Of course other fastening arrangements may be used as desired and as may be required by the nature of the surface (e.g., wood, cement).

It is also preferred that the second receptacle be positioned into the ground with its flange positioned proximate or near the surface of the ground. Here too, the second flange may have a plurality of apertures formed therein to receive stakes or spikes, or other connectors to secure the second receptacle to the ground or support surface.

In a preferred arrangement, the first upright and the second upright are cylindrical in shape. The first receptacle and the second receptacle each are also cylindrical in shape and sized to snugly and removably receive the first upright and the second upright respectively therewithin.

In another preferred configuration, a cap is provided to be removably and snugly positionable into the first receptacle to cover the upper end thereof and alternately to be positioned in the upper end of the first upright to cover the upper end thereof. Similarly, another cap may be provided to be sized to be snugly and removably positioned into the upper end of the second receptacle. Similarly, the cap may be positioned into the upper end of the second upright.

In an alternate configuration, the first upright is formed into a first plurality of interconnecting sections each having a selected length. The first plurality of interconnecting sections includes a first section having a lower end and a second section having an upper end each configured to form a telescoping connection therebetween. The second upright is also formed into a plurality of interconnecting sections each having a selected length in which a first section has a lower end and a second section has an upper end each configured to effect a telescoping connection therebetween.

In yet another alternate arrangement, the first plurality of interconnecting sections of the first upright and also of the second upright each have a third section having the lower end formed for connection to said first base and to said second base respectively and an upper end sized to telescopically connect with the lower end of the second section of the first plurality of interconnecting sections.

A preferred game net of the game system has a top and a bottom. The right securing means includes an upper strap member positioned to secure the top of the game net to a selected one of the net-securing structures of the first upright. The right securing means also includes a lower strap member positioned to secure the bottom of the game net to a selected another of the net-securing structures of the first upright. One of the upper strap members and the lower strap members is formed of an elastically-deformable material. The other of the upper strap and the lower strap is formed of a substantial inelastically-deformable material. Preferably, the upper strap member is formed of an elastically-deformable material.

The left securing means of the game net preferably includes an upper strap member positioned to secure the top of the game net to a selected one of the net-securing structures of the second upright. The left securing means also includes a lower strap member positioned to secure the bottom of the game net to yet another of the net-securing structures of the second upright. One of the upper strap members and the lower strap members of the left securing means is formed of an elastically-deformable material. The other of the upper strap member and lower strap member is formed of a substantially inelastically-deformable material.

Preferably the upper strap of the left securing means is made of an inelastically-deformable material that includes adjustment means for adjusting the length of the strap between the game net and the second upright. The adjustment means may include a plurality of hooks or eye devices spaced apart along the length of the upper strap for interconnecting with the corresponding hook or eye connecting structure associated with the upright.

The upper strap and the lower strap of the right securing means may also have hooks or eye associated proximal their distal end for interconnection with hook- or eye-receiving structure associated with the first upright. In a highly preferred configuration, the first upright and the second upright are each tubular with slots formed in the sidewalls sized to receive a hook therethrough. An aperture is formed in the sidewall relative to each slot to receive the point of a hook therethrough.

In another configuration of the invention, the net-securing structures of the first upright and the second upright include a net-securing structure to secure a game net at a selected height above the supporting surface. The net-securing structures are positioned along the length of the first upright and the second upright for connection of the net therebetween for at least two of the games of men's volleyball, women's volleyball, badminton and lawn tennis.

Alternately, the net-securing structures may be positioned along the length to secure the net to receive golf balls struck by a user. In this configuration, the mesh is selected of such a size to resist passage of a golf ball therethrough. The net-securing structures are positioned for locating the game net proximate the support surface.

The net-securing structures of the plurality of net-securing structures of the first upright and second upright may also be positioned along the length of the first upright and the second upright for locating the game net as a soccer goal. The game net may also be formed to be more effective as a soccer goal having a net stretched portion which extends away from the first connecting structure and second connecting structure in an arcuate fashion in the form of a receptacle for soccer balls.

Storage means may be connected to a selected one or the other of the first upright and the second upright. Preferably the net storage means includes a pair of spaced apart dogs having a single arm extending selectively outward to provide a retaining member and to receive and retain the net when wrapped thereabout.

In yet an alternate configuration, an attaching structure may be positioned proximate the upper or distal end of a selected one or the other of the first upright and the second upright. A game structure may be suspended therefrom. The game structure may be a tetherball having a line with means at its distal end to connect to the attaching means and with a ball positioned proximate the other end. The ball may be retained on the line by a netting system.

In yet an alternate configuration, the first upright has a connecting structure; and the second upright has a second connection structure. Preferably the game system includes a line that extends between the two uprights and more particularly the two connecting structures associated therewith.

A ball transport means is positioned to move along the line. Ball suspension means are attached to the ball transport means to extend away therefrom with a ball attached to the ball suspension means positioned for sting by a user with a bat. The ball has an aperture preferably formed therethrough. The ball suspension means extends into and through the ball.

The ball suspension means may include a linked metal chain. A first bore is formed into the ball. The first bore has a cross section sized to snugly receive the linked metal chain therein. A second bore is in communication with the first bore and extends through the ball to the exterior thereof. The second bore has a cross section less than the cross section of the first bore. Preferably the ball suspension means includes a rope member that extends through a length of the chain of the ball suspension member. The rope member is then formed with a knot to inhibit passage of the rope through the aperture to retain the ball on the ball suspension means. The first bore and the second bore are desirably in axial alignment. Most preferably, the first bore has an axial length that extends from the surface of the ball inwardly from about one-fourth to about three-fourths the diameter of the ball. Most preferably, the first bore has a length of about one-half the diameter of the ball. Ideally, the first bore extends substantially radially towards and through the center of the ball.

The line that extends between the first upright and the second upright preferably has adjustment means for adjusting the length of the line. The first adjustment means is a turnbuckle. Alternately, the first adjustment means may be a length of chain having a plurality of links to removably attach to structure such as a hook on the upright.

The line may also include a second adjustment means to adjust the length of the line. That is, the first adjustment means may be a turnbuckle with the second adjustment means being a length of chain to interconnect to a hook. The length of chain of the ball suspension means preferably has a sheath positioned thereabout. A stock stop may be positioned on the line spaced from the first upright. Another stop may be spaced from the second upright and is preferably between the first stop and the first adjustment means and second adjustment means.

The ball transport means is positioned to transport the ball, after it is struck, between the first stop and the second stop. The ball transport means may be a simple metal ring positioned to move along the line.

Desirably, the line extends on a diagonal from proximate the upper end of one of the uprights and a proximate middle or lower portion of the other upright.

A lower attachment means positioned proximate but spaced above the supporting surface may also have a line interconnected thereto with a ball secured proximate the outer end of the line. The ball may be secured to the line by use of a net or by a hook, a bolt or the like formed in the side wall of the ball.

The system of the invention may alternately include another baseball striking structure in which a collar is positioned about an upright with an extension extending outwardly therefrom. A ball is positioned near the outer end of the extension at a height for striking by a user.

In other alternate or different configurations, the components may be assembled for use in a selected one or two or more of the particular games as desired by the user.

BRIEF DESCRIPTION OF THE DRAWINGS

In the drawings which illustrate what is presently regarded as a mode for carrying out the invention.

DETAILED DESCRIPTION OF THE ILLUSTRATED EMBODIMENT

Figure 1:
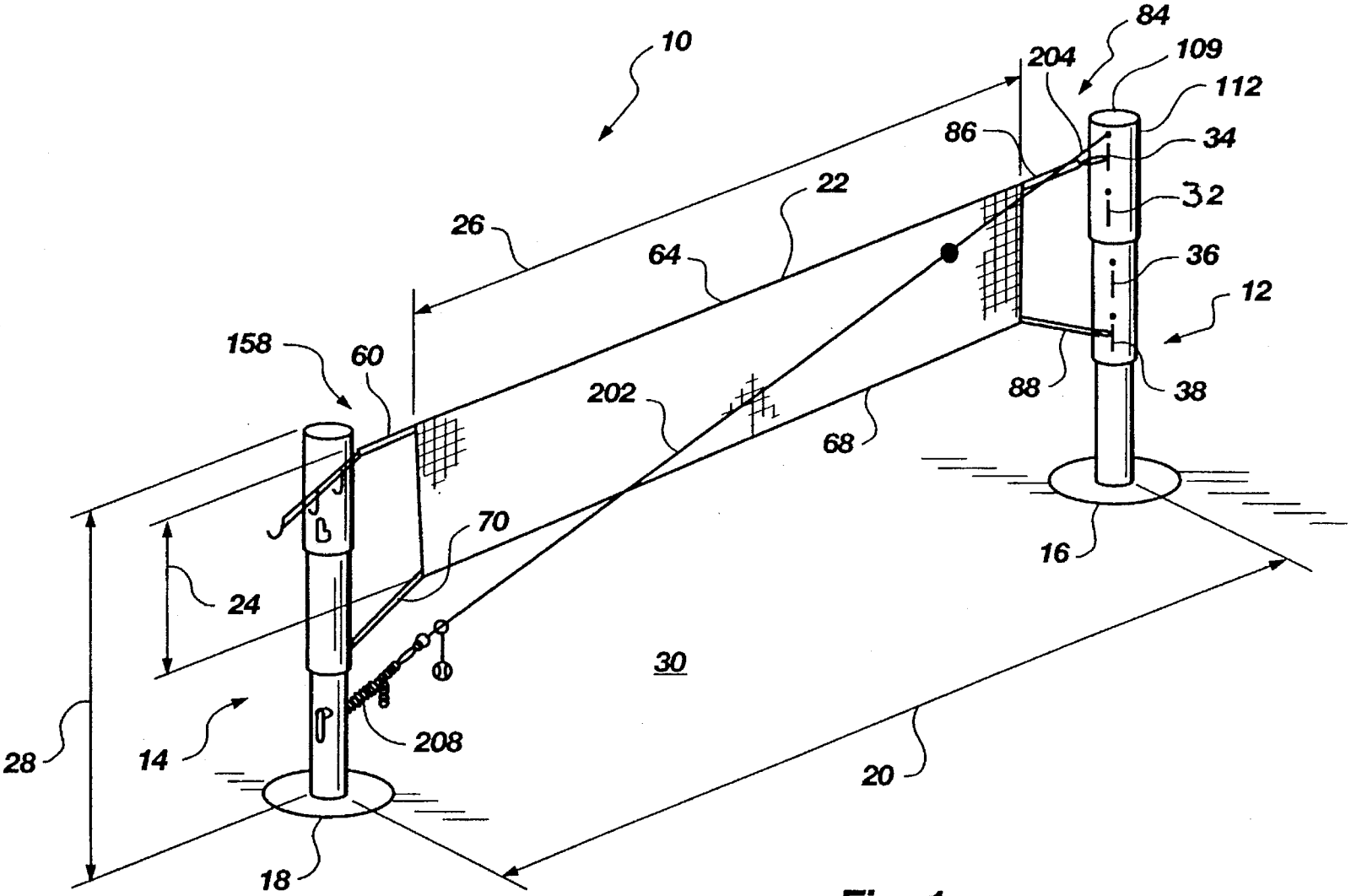
FIG. 1 is a perspective representative illustration of a game system of the invention.

FIG. 1 illustrates a game system 10 having a first upright 12 and a second upright 14. The first upright 12 is secured to a first base 16 as more fully discussed hereinafter. The second upright is secured to a second base 18 as more fully discussed hereinafter.

As seen in FIG. 1, the second base 18 is spaced from the first base 16 a preselected distance 20. That is, the distance 20 is selected based on the space available in the user's backyard or in an appropriate playground or park area. It is also selected based on dimensions provided by various gaming authorities for the performance of certain games such as men's volleyball, women's volleyball, lawn tennis, badminton and the like.

As shown in FIG. 1, a game net 22 is provided. It has a height 24 and a width 26 which may be selected to the precise desired height and width specified by a particular gaming authority for use in playing games such as men's volleyball, women's volleyball, tennis or the like. Alternately, there may be an acceptable series of dimension, although it may not necessarily be the dimensions dimensions required by a particular gaming authority. That is, in backyard recreation, it is suggested that the precise dimensions for a specific sport defined by gaming authorities may not be necessary. Therefore, a single net may be adapted simply by adjusting its width 26 to meet the space available. Here the upper edge of the game net 22 may be appropriately positioned at a length 28 relative to the support surface 30 or ground to function adequately or sufficiently for lawn tennis, for badminton, for women's volleyball, men's volleyball or other similar net related sports.

The first upright 12 in FIG. 1 is shown to have a plurality of net-securing structures 32, 34, 36 and 38 positioned along the length 28 of the first upright 12. A similar set of net-securing structures are associate with the second upright 14 that are not shown here by virtue of the orientation and perspective.

The game net 22 has fight securing means for securing the game net 22 to a selected one or two of the plurality of net-securing structures 32, 34, 36 and 38 of the first upright. The game net 22 similarly has second securing means for securing the game net 22 to a selected one of the plurality of net-securing structure. The net-securing structures of the first upright and second upright are selected to position the net 22 in a first position for performance of a first game and to a second position for performance of a second game.

Figure 2:
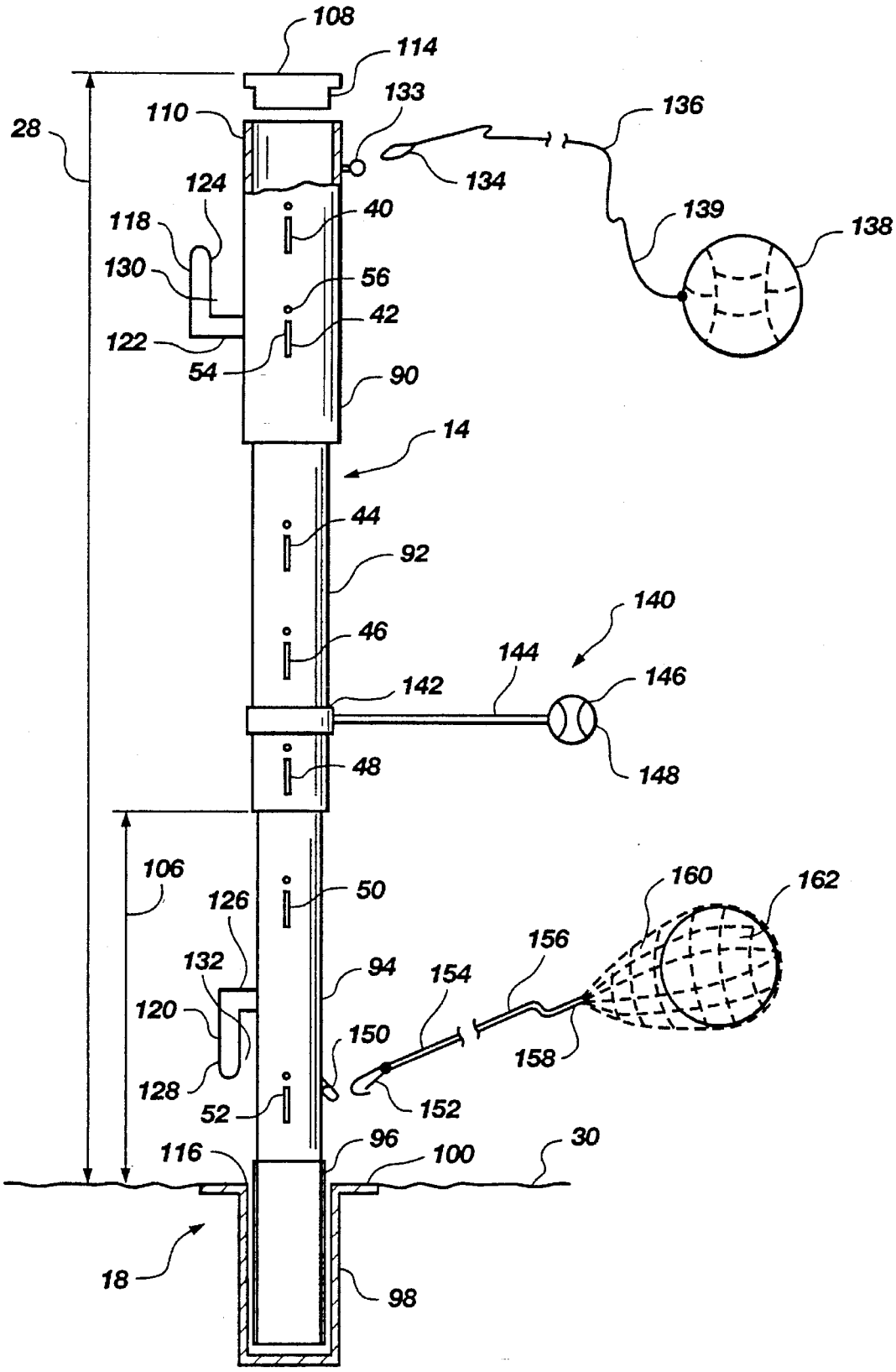
FIG. 2 is an upright member for use in the game system of FIG. 1.

More particularly in FIG. 2, it can be seen that the net-securing structures 40, 42, 44, 46, 48, 50 and 52 of the second upright are positioned spaced apart along the length 28 thereof at a specific height to receive the net-securing means to in turn position the net 22 at a desired height for the performance of different games as hereinbefore stated. The first upright 12 is similarly configured.

As can be seen in FIG. 2, the net-securing structures 40, 42, 44, 46, 48, 50 and 52 are here slots, such as slot 54, sized in width and in height to receive a selected hook therethrough. An aperture 56 is positioned relative to each of the slots, such as slot 54, to receive the point or tip of a hook therethrough to securely receive the hook and retain it therewithin until specifically removed by the user.

Figure 4:
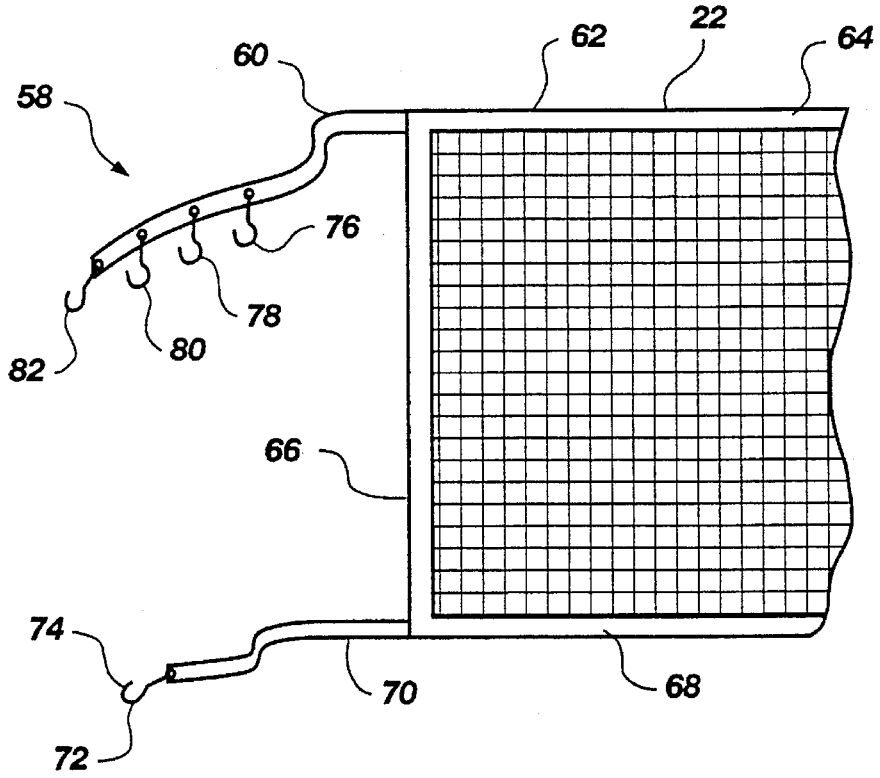
FIG. 4 is a portion of a net usable with the game system of FIG. 1.

As better seen in FIG. 4, the net 22 has a left securing means 58, which includes an upper strap 60 secured to the upper portion 62 of the net 22. As here shown, the net has a tape or piping stitched along its upper edge 64 and along its outer side 66. It also has similar piping or tape stitched along the lower edge 68.

The securing means 58 includes a lower strap 70 connected near or proximate the lower edge or bottom 68 of the net 22 to extend away therefrom. A hook 72 is positioned proximate the distal end of the strap 70. The hook 72 has a tip or point 74 to interconnect with the aperture, such as aperture 56, after the hook 72 is inserted through the slot, such as slot 54 of the net-securing structures formed in the first upright 12 and the second upright 14.

The upper strap 60 has a plurality of spaced-apart hooks 76, 78, 80 and 82 for interconnection with a selective net-securing structure, such as net-securing structures 40, 42, 44, 46, 48, 50 and 52. Alternately, the net-securing structure may be hooks to interconnect to eye devices or eye hooks attached to the strap 60.

In FIG. 1, the net-securing means 84 is shown here to be comprised of an upper strap 86 and a lower strap 88. The lower strap 88 of the right securing means 84 is comparable to the strap 70 of the left securing means 58. The upper strap 86 of the right securing means 84 is secured to extend away from the upper edge 64 of the net 22 with a single hook (or eye), such as hook 82, positioned proximate its outer end. Similarly, the strap 88 has a hook (or eye) similar to a hook 72 positioned proximate its outer end. The hooks (not shown) of the straps 86 and 88 interconnect with the net securing structure 32, 34, 36, 38 positioned along the length 28 of the first upright 12.

It may be noted that in FIG. 1, only four net-securing structures are shown positioned along the length 28 of the first upright 12. It should be understood that a number of different additional net-securing structures comparable to those shown for the left upright 14 in FIG. 2 may be formed in the first upright 12. Additional net-securing structure may be positioned or formed along the length 28 of either or both the first upright 12 and the second upright 14 as desired to position the game net 22 for selected games.

It may be also noted that the net-securing structure formed along the length 28 of the first upright 12 and the second upright 14 may be any suitable mechanical structure, including eyelets, bolts, or the like, all formed or shaped to interconnect with any desired corresponding securing mechanism associated with the straps 60, 70, 86 and 88.

It should also be noted that the securing means 84 of the game net 22 has at least one of the straps 86 and 88 formed of an elastically-deformable material. The other strap is formed of an inelastically-deformable material. In the embodiment of FIG. 1, the upper strap 86 is formed of an inelastically-deformable material and is preferably formed of the same material, such as the tape or piping 62 positioned along the upper edge 64 of the net 22. The lower strap thereafter is formed of an elastically-deformable material, such as a rubber or neoprene-type material, that may be desirably sheathed or encased in a similarly elastic material.

The left securing structure 58, and more specifically the upper strap 60 and the lower strap 70, are also formed so that one of the upper strap 60 and lower strap 70 is formed of an elastically-deformable material. The other is formed of an inelastically-deformable material. In the illustrated embodiment of FIGS. 1, 2 and 4, the upper strap 60 is formed of an inelastically-deformable material. That is to say, it is substantially inelastically-deformable even though it may have some elasticity if sufficient strain is applied thereto.

The lower strap 70 is formed of an elastically-deformable material. A bungee cord or similar-type rubber elastically-deformable material would be suitable and could be encased within a strap or piping material comparable to the strap or piping along the lower edge 68 of the net 22.

In operation, it can be seen that the net 22 may be easily installed by one person. That is, a right lower strap 88 may be inserted in a selected net-securing structure, such as net-securing structure 38. The upper strap 86 may be thereupon inserted in its associated upper and spaced-apart net-securing structure 34. The user may then lay out the net and proceed to the left upright 14. The user may then grasp the lower elastic strap 70 and stretch it for interconnection into and securing the lower edge 68 of the net 22 by placing the hook 72 in the selected or desired net-securing structure of the second upright 14. Thereupon, the user can grasp the upper strap 60 and place a desired hook and in turn effect a desired tensioning on the upper edge 64 of net 22 upon placement of the hook, such as hook 76, 78, 80 or 82, in its associated and desired net-securing structure, such as net-securing 40.

As above-described, it can be seen that a single user may easily place the net between the first upright in between and to the first upright 12 and in between and to the second upright 14.

Referring again to FIG. 2, it can be seen that the upright 14 is formed of three sections, such as upper section 90, middle section 92 and lower section 94. The lower section 94 may have a collar 96 positioned thereabout to provide for a wearable and secure, snug fit with the receptacle 98 of the illustrated base 18. More specifically, the base 18 is positioned into or under the support surface 30 or ground. A upper flange 100 is secured to the receptacle 98. Securing means are associated with the upper flange 100 for attaching the base 18 securely to the support surface 30 as more fully discussed hereinafter.

The collar 96 of the lower section 94 is positioned snugly and securely within the receptacle 98. Desirably, the receptacle as well as the section 94 are each cylindrical to provide for ease in installation and strength after installation. The lower section 94 telescopes into the middle section 92. The middle section 92 telescopes into the upper section 90.

Figure 5A:
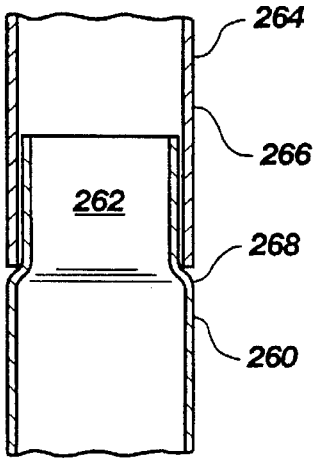
FIGS. 5 and 5A show portions of adjoining sections of an upright for use with the game system of FIG. 1.
Figure 5:
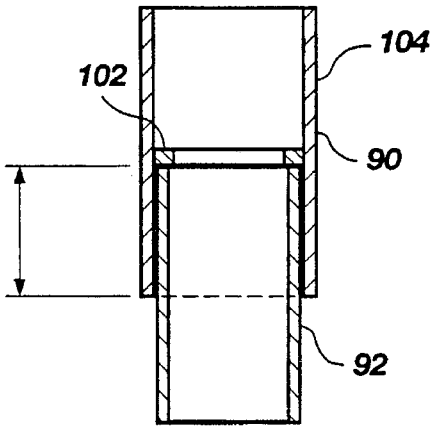

As better seen in FIG. 5, the middle section 92 telescopes into the upper section 90 abutting a stop 102 positioned within and extending around the interior wall 104 of the section 90. A similar telescoping relationship exists between the lower section 94 and the middle section 92 and is not here illustrated. FIG. 5A shows a preferred configuration in which the lower section 260 (comparable to section 92) has a necked portion 262 sized to snugly and slideably fit into the adjoining section 264. The lower end 266 of the adjoining section 264 rests on the shoulder 268.

Although the units here may be separately taken apart and stacked next to each other for ease in transportation, they may also not have the stops 102 but may be configured to telescope into each other if desired.

It may be noted that three sections are here provided. The overall length 106 is from about 2½ to about 3 ½ feet so that the related body of the container into which the entire system may be placed for purposes of shipping and/or storage is of an acceptable dimension for storage and/or shipping.

FIG. 2 also shows a cap 108, which may be inserted into the upper or distal end 110 of the upper section 90 of the upright 14. A similar cap 109 is insertable into the upper or distal end 112 of the upright 12. The cap 108 is sized with a throat 114 so that it may be inserted into the upper end 116 of the base, and more particularly the receptacle 98. That is, upon removal of the related upright 14 and 12, the cap 108 may be removed from the upper end 110 and 112 and then placed in turn in the aperture or opening of the receptacle 98, and more specifically the upper end 116 of the receptacle 98 is provided to inhibit rain and trash from gathering therein in the receptacle when it is placed in an outdoor environment.

FIG. 2 also shows net-securing means comprised of an upper dog 118 and a lower dog 120. That is, the upper dog 118 has an extension 122 and an arm 124 oriented away from or to extend upwardly along the upright member 14. The lower dog 120 has an extension 126 and an arm 128 to extend downwardly and away from the upright member 14. In effect, it can be seen that a space 130 and 132 is provided so that the net 22 may be wound thereabout for storage when not in use. Alternately, a second net may be stored on the dogs 118, 120 if desired.

FIG. 2 also shows an upper attaching means, such as an eye bolt 133. It may be secured by threads, nut welding or by bolts into the wall 104 of the upper section 90. A corresponding snap hook 134 is secured to the distal end of a line 136. A ball 138 is secured to the other end 139 of the line 136. The ball 138 may also be secured by a net similar to the lower ball as hereinafter discussed. Although the ball 138 and line 136 are shown extending outwardly away from the upright member 14, gravity would cause them to hang downwardly proximate the upright member 14 and in turn function as a tetherball for use in performing a tetherball-type game.

A baseball practice structure 140 is also illustrated in FIG. 2. The baseball structure includes a collar 142 positioned about the section 92 of the upright 14. The collar provides for a snug and rotatable fit about the upright 14. A rigid extension 144 is secured to the collar 142 with a ball device 146. A user may thus take a bat and strike the ball device 146. The ball device 146 may thus proceed around the post. Alternately, the rigid extension 144 may be flexible and bend when the ball is struck. Thus, the user may use a bat in order to practice swinging the bat and striking a ball.

FIG. 2 also depicts eye bolt 150, which is sized to receive a snap hook 152 connected to the distal end 154 of line 156. Line 156 at its other end 158 is connected to a net structure 160. The net structure contains a ball 162, which may be sized proximate a soccer ball. The ball 162 may contact the ground 30 and may be struck by the user's foot to practice soccer-type exercises or skills.

Figure 6:
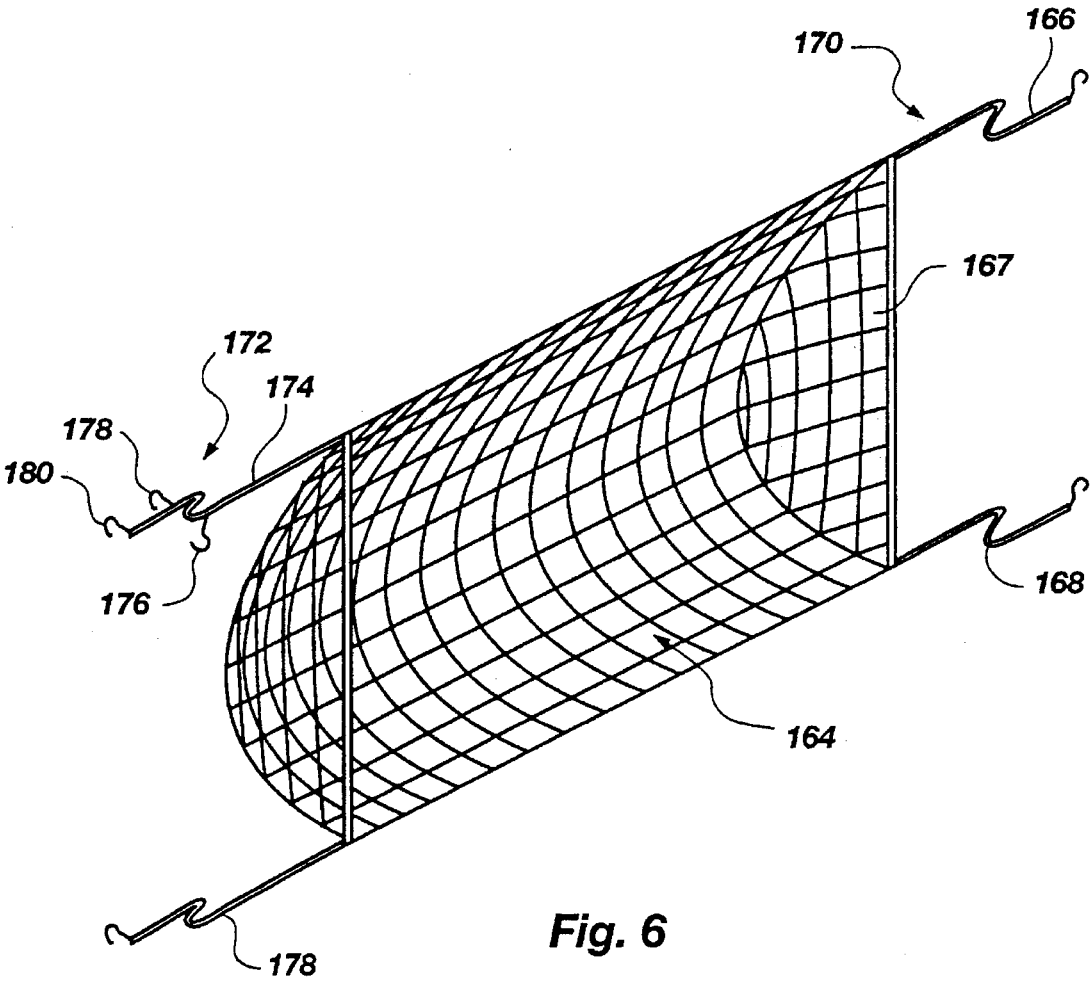
FIG. 6 shows a second net structure usable with the game system of FIG. 1.

In FIG. 6, a net 164 is shown, which may be positioned in lower net-securing structures along the uprights 14 and 12 so the user may practice kicking the ball 162 into the net 164 when the net 164 is in fact secured between the uprights 12 and 14. Alternately, a free movable soccer ball 162 may be used if desired.

Referring to FIG. 6, the net 164 there illustrated has a mesh 167, which is sized to inhibit the passage of golf balls therebetween. The net 164 has an upper strap 166 and a lower strap 168 on the right side to constitute right securing structure 170. Left securing structure 172 includes an upper strap 174 and a lower strap 178. The lower straps 168 and 178 may be formed of an elastically-deformable material with hooks positioned proximate their distal end. The upper straps 166 and 174 may also be made of an elastically-deformable material or may be made of inelastically-deformable material. In either case, they have a hook positioned proximate their distal ends. In one configuration, the strap 174 may be inelastically-deformable and include multiple hooks 176, 178 and 180 for connection to an associated net-receiving structure, such as net-receiving structure 48. After installation between the first upright 12 and the second upright 14, the user may use the net 164 as a soccer net or, alternately, to receive golf balls. If golf balls are not to be used, however, the mesh 167 may be selected to have a greater separation of the individual strands comparable to typical soccer nets.

Figure 3:
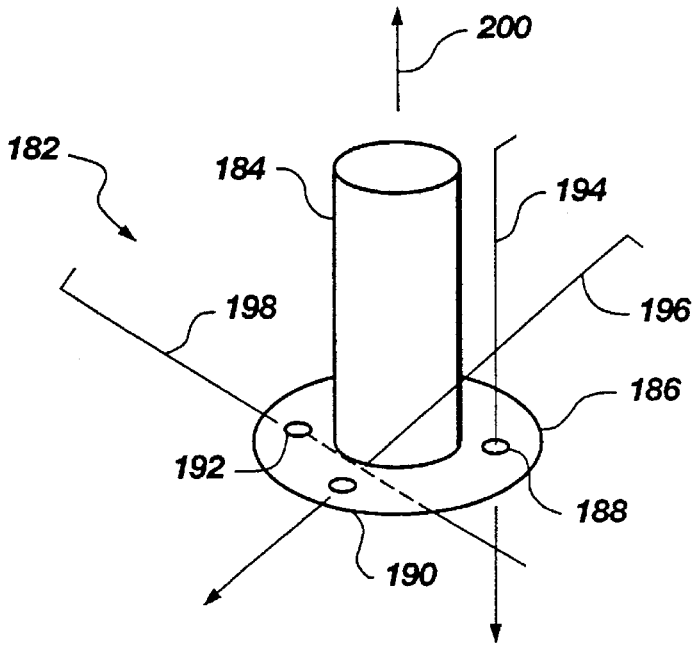
FIG. 3 illustrates an alternate base structure for use in supporting an upright for use with the invention shown in FIG. 1.

Referring now to FIG. 3, an alternate base structure 182 is depicted. It has a receptacle 184 with a flange 186 connected thereto. A plurality of apertures 188, 190 and 192 are shown formed in the flange 186. Securing means, such as rods 194, 196 and 198, are provided. The rods 194, 196 and 198 may be pushed through the apertures 188, 190 and 192 and into the surface 30 to secure the flange 186 thereto. With the orientation of the base 182 comparable to that shown in FIG. 2, the rods 194, 196 and 198 are urged through similar apertures downwardly into the ground or support surface 30. It may be noted in FIG. 3 that the rods 194, 196 and 198 are urged through their respective apertures 188, 190 and 192 at an angle in order to resist rotation and to resist outward or upward 200 movement of the receptacle relative to the surface 30. If the surface 30 is wood, concrete or the like, nails, screws, compression bolts or the like may be used, as well as various adhesives.

Figure 7:
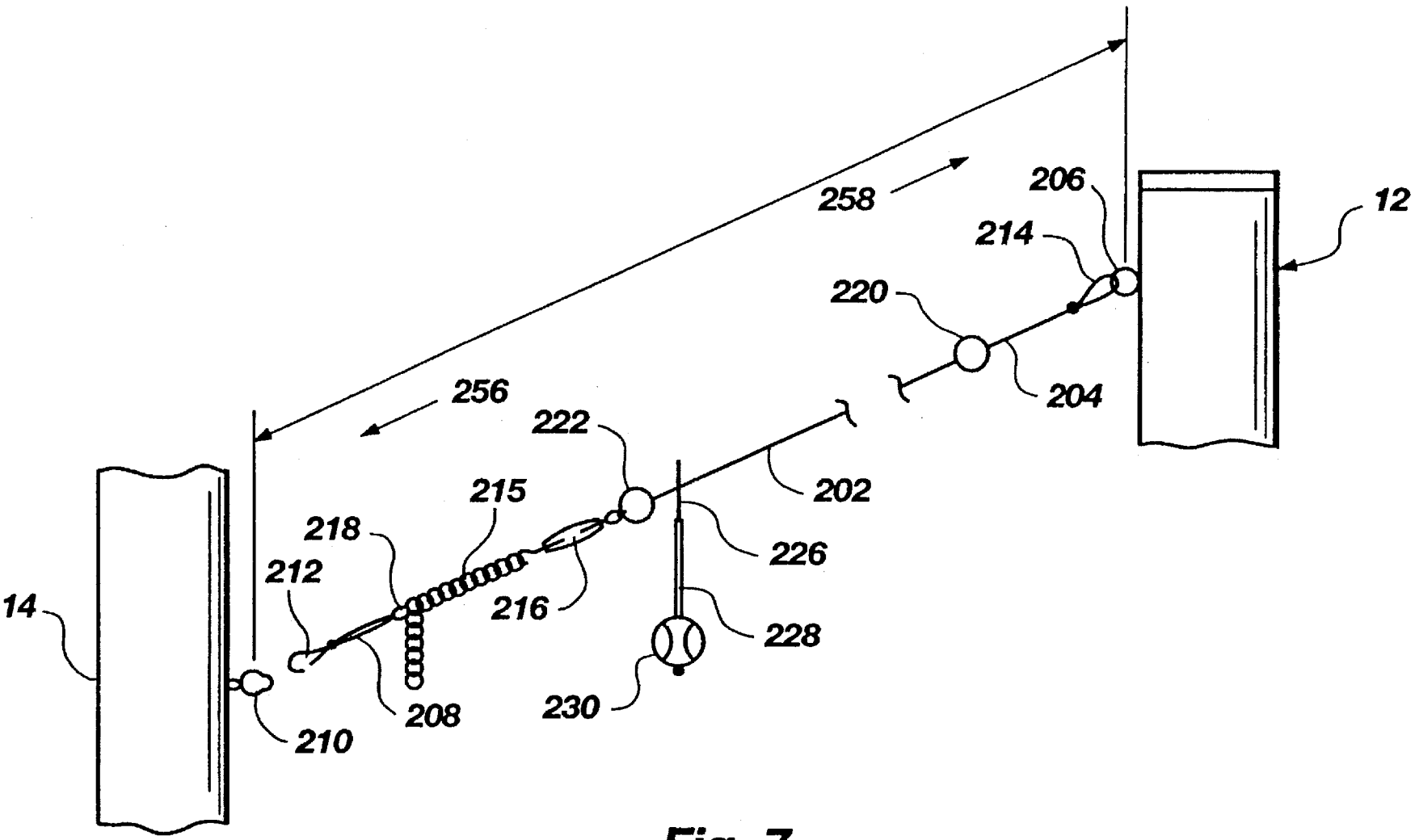
FIG. 7 shows a baseball practice structure for use with the game system of FIG. 1.

In FIG. 1 and FIG. 7, a baseball practice structure is shown that includes a line 202 that extends between the first upright 12 and the second upright 14. The line 202 is here shown extending at a diagonal with one end 204 connected to an upper eye bolt 206 here proximate the upper distal end of either the first upright 12 or the second upright 14 as desired. The other end 208 of the line 202 is connected to a lower eye bolt 210, which is connected to the other upright, such as the second upright 14. The other end or lower end 208 of line 202 has a snap hook 212 to connect to the eye bolt 210. The upper end 204 also has a snap hook 214 to connect to the eye bolt 206.

Figure 8:
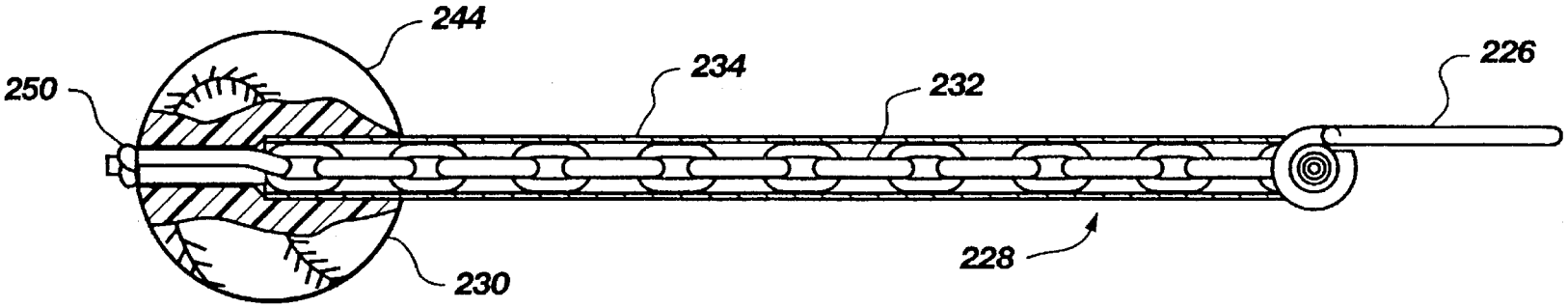
FIG. 8 is a cross-sectional representation of portions of the components shown in FIG. 7.
Figure 9:
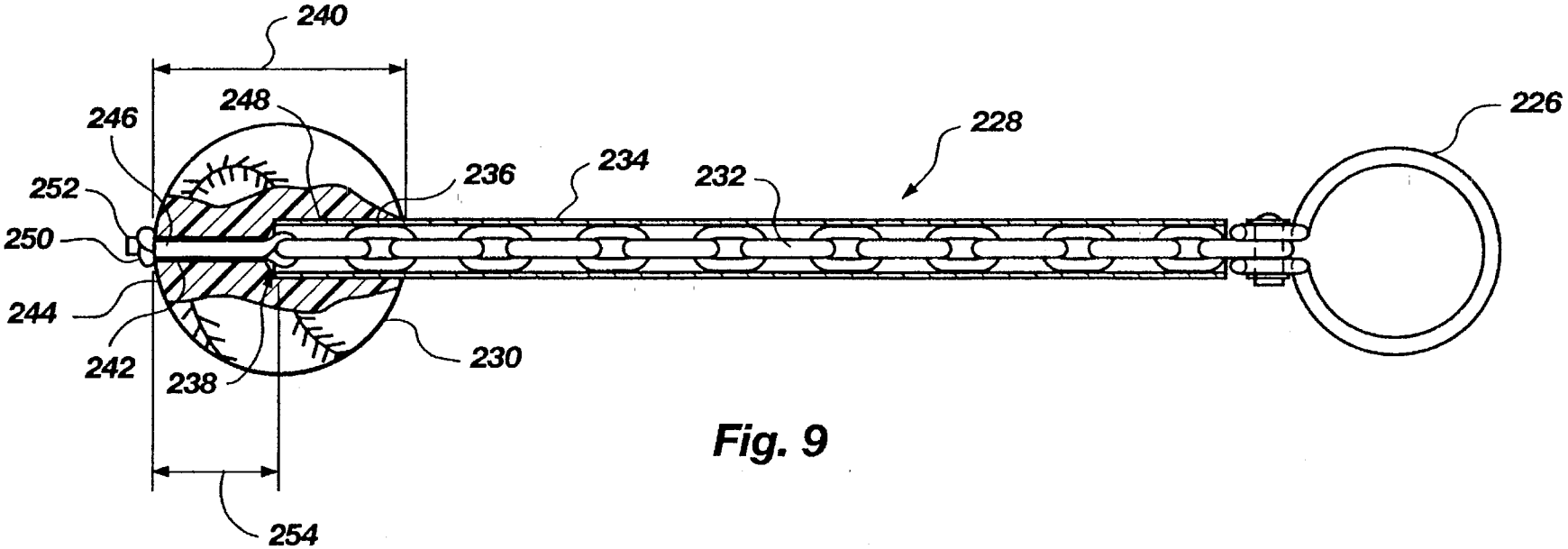
FIG. 9 is a cross-sectional view of the structure of FIG. 8 rotated approximately 90°.

Adjustment means are provided for the line 202. The adjustment means may include a turn buckle 216, which is positioned in the line and operates in a conventional fashion to tension the line 202 between the first upright 12 and the second upright 14. A second adjustment means may also be provided, which is here shown to be a linked chain 215. The linked chains interconnect with a second hook 218 associated with the lower end 208 of the line 202. Alternately, the eye bolt 210 may be, in fact, a simple open hook into which a link of the linked chain 215 is hooked in order to tensionally secure the line 202 between the first upright 12 and second upright 14. The line 202 also has an upper stop 220 secured therealong spaced away from the upper end 204 a short distance (e.g., one to one and one half feet) selected by the user. A lower stop 222 is also provided. A ball transport structure is positioned to move along the line 202. As better seen in FIGS. 8 and 9, the ball transport structure is simply an open ring 226.

A ball suspension means 228, such as chain link 232, is provided to interconnect the ball transport device, such as the ring 226, to a ball 230. As stated, the ball suspension means 228 is a linked chain 232 with a sheath 234 placed thereabouts. The sheath 234 is preferably formed of a vinyl or other similar material to protect the chain and also to protect any wooden bat that might accidentally hit the chain if the user misses the ball 230 and hits the chain.

The ball 230, as here shown, is a conventional hard ball used to play baseball. It has a first bore 236 formed therein to extend radially towards the center of the ball 230 selected to be from about ¼ to about ¾ the overall diameter 240 of the ball 230. As here shown, it preferably extends approximately ½ the diameter 240. A second bore 242 is formed to extend from the first bore 236 to the exterior surface 244 of the ball 230. The first bore 236 has a cross-section sized to receive the ball suspension means 228 snugly but removably therein. More specifically, the chain 232 and its sheath 234 are snugly positioned within the first bore 236. A rope 246 is positioned within the second bore 242 to interconnect or loop over a link 248 of the chain link 232. The rope 246 has a knot 250 formed at its outer end to pivot movement of the rope 246 and the knot 250 through the second bore 242. The rope 246 is preferably a nylon rope material with a burned or hot-cut edge 252.

The second bore 242, as can be seen, is sized in length approximately ½ in length 254 approximately ½ the diameter 240 of the ball 230.

The configuration here shown is found to be preferable. If a rope is used in lieu of link chain, it has been found that the rope rapidly deteriorates in use by chafes around the surface where it would interface with the surface of a ball, such as ball 230. Extension of the chain 232 all the way through the ball 230 further causes wear on the ball leading to deterioration of and/or allowing the chain 232 to break after repeated hitting with a baseball bat. The use of the configuration here illustrated provides for certain elasticity or give between the ball 230 and the ball-suspending structure 228 while at the same time providing for rigidity and strength.

In operation, the line 202 is positioned such that the ball 230 is located at a height above the ground selected for sting the ball 230 with a baseball bat. After striking the ball 230 with a baseball bat, the ball transport structure 224 moves with minimal friction along the line 202 until it contacts the upper stop 220, whereupon it proceeds by gravity backwards along the line 202 towards the lower stop 222. As the ball 230 moves in downward direction 256 along line 202, it may be again struck with a baseball bat so that the operator has the opportunity to hit a moving ball and develop the eye-hand and arm coordination associated with hitting a moving ball. Alternately, the ball 230 can come to rest against the lower stop 222. Thereupon, it can be struck yet again to move in upward direction 258 along the line 202 so the user may practice striking a ball and exercising the associate muscles.

It may also be seen that the net 22 of FIG. 1 may also be positioned at a height above the ground for use in playing lawn tennis. Other games may be selected or desired based on the height or orientation of the net 22 when positioned as desired by the user between the first upright 12 and the second upright 14 by selecting a desired net-securing structure along the length 28 of the first upright 12 and the second upright 14.

It should be understood that the above-described embodiments are not intended to limit the scope of the claims, which themselves recite those features which are essential to the invention.

What is claimed is:

1. A game system comprising:

a first upright positioned to extend upwardly from a support surface, said first upright having a length and a plurality of net-securing structures associated therewith and spaced apart along said length;

a second upright positioned to extend upwardly from a support surface, said second upright having a length and a plurality of net-securing structures associated therewith and spaced apart along said length;

a game net having right securing means for connection to a first selected of said plurality of net-securing structures of said first upright at a first position along the length thereof for use as a net in a first game and to a second selected of said plurality of net-securing structures of said first upright at a second position along the length thereof for use as a net in a second game, said game net having left securing means for connection to a first selected of said plurality of net-securing structures of said second upright at a first position along the length thereof for use as a net in a first game and to a second selected of said plurality of net-securing structures of said second upright at a second position along the length of said second upright for use as a net in said second game;

a first base securable to a support surface and a second base securable to a support surface wherein said first base is a receptacle sized to snugly and removably receive said first upright and wherein said second base is a receptacle sized to snugly and removably receive said second upright;

said first base has a flange attached to said first receptacle and means for securing said first flange to a support surface wherein said first receptacle is positioned through and into said support surface:

said second base has a flange attached to said second receptacle and means for securing said second flange to a support surface wherein said second receptacle is positioned through and into said support surface;

a first cap snugly and removably positioned alternately into said first receptacle to cover the upper end thereof and into the first upright to cover the upper end thereof: and a second cap snugly and removably positionable alternately into said first receptacle to cover the upper end thereof and into the first upright to cover the upper end thereof.

2. The game system of claim 1 wherein said first receptacle and said second receptacle are cylindrical in shape.

3. A game system comprising:

a first upright positioned to extend upwardly from a support surface, said first upright having a length and a plurality of net-securing structures associated therewith and spaced apart along said length;

a second upright positioned to extend upwardly from a support surface, said second upright having a length and a plurality of net-securing structures associated therewith and spaced apart along said length;

a game net having fight securing means for connection to a first selected of said plurality of net-securing structures of said first upright at a first position along the length thereof for use as a net in a first game and to a second selected of said plurality of net-securing structures of said first upright at a second position along the length thereof for use as a net in a second game, said game net having left securing means for connection to a first selected of said plurality of net-securing structures of said second upright at a first position along the length thereof for use as a net in a first game and to a second selected of said plurality of net-securing structures of said second upright at a second position along the length of said second upright for use as a net in said second game, said game net having a top and a bottom and said right securing means of said game net including an upper strap member positioned to secure the top of said game net to a selected one of said net-securing structures of said first upright and a lower strap member positioned to secure the bottom of said game net to a selected another of said net-securing structures of said first upright, one of said upper strap members and said lower strap members being formed of an elastically-deformable material and the other of said upper strap and said lower strap being formed of a substantially inelastically-deformable material.

4. The game system of claim 3 wherein said left securing means of said game net includes an upper strap member positioned to secure the top of said game net to a selected one of said net-securing structures of said second upright and a lower strap member positioned to secure the bottom of said game net to another of said net-securing structures of said second upright, one of said upper strap members and said lower strap members of said left securing means being formed of an elastically-deformable material and the other being formed of a substantially inelastically-deformable material.

5. The game system of claim 4 wherein said upper strap of said left securing means is made of an inelastically-deformable material and includes adjustment means for adjusting the length of the strap between the game net and said second upright.

6. The game system of claim 5 wherein said upper strap of said right securing means is made from said inelastically-deformable material.

7. The game system of claim 6 wherein said upper strap and said lower strap of said fight securing means each have distal ends and each have hooks connected proximate thereto, and wherein said plurality of net-securing structures of said first upright each include hook receiving structure formed to removably receiving said hooks.

8. The game system of claim 7 wherein said lower strap has a distal end with a hook secured proximate thereto and wherein said adjustment means includes a plurality of spaced apart hooks secured to said upper strap along its length and wherein said plurality of net-securing structures of said second upright each include hook receiving structure formed to removably receive said hooks.

9. The game system of claim 8 wherein said first upright and said second upright are each tubular and each have a sidewall, wherein said hook receiving structure of said first upright and said second upright includes a slot in said sidewall sized to receive said hook therethrough and an aperture formed in said sidewall relative to said slot to receive the point of a hook therethrough.

10. The game system of claim 9 wherein said net-securing structures are positioned along the length of said first upright and said second upright for two of at least the games of men's volleyball, women's volleyball, badminton and lawn tennis.

11. The game system of claim 9 wherein said game net has a net member with a mesh to resist passage of a golf ball therethrough and wherein selected net-securing structures of said plurality of net-securing structures of said first upright and said second upright are positioned for locating said game net proximate the support surface as a golf ball practice net.

12. The game system of claim 9 wherein selected net-securing structures of said plurality of net-securing structures of said first upright and said second upright are positioned for locating said game net as a soccer goal.

13. A game system comprising:

a first upright positioned to extend upwardly from a support surface, said first upright having a length and a plurality of net-securing structures associated therewith and spaced apart along said length;

a second upright positioned to extend upwardly from a support surface, said second upright having a length and a plurality of net-securing structures associated therewith and spaced apart along said length;

a game net having right securing means for connection to a first selected of said plurality of net-securing structures of said first upright at a first position along the length thereof for use as a net in a first game and to a second selected of said plurality of net-securing structures of said first upright at a second position along the length thereof for use as a net in a second game, said game net having left securing means for connection to a first selected of said plurality of net-securing structures of said second upright at a first position along the length thereof for use as a net in a first game and to a second selected of said plurality of net-securing structures of said second upright at a second position along the length of said second upright for use as a net in said second game; and attaching means secured to one of said first upright and said second upright proximate to removably receive a game structure; and wherein the other of said first upright and said second upright has a connecting structure secured thereto at a selected height above the support surface below the shoulders of a user standing proximate the other of said first upright and said second upright, and wherein said game system includes a line extending between said attaching means and said connecting structure with a ball transport means positioned to move along said line, said ball transport means having a ball suspension means connected thereto to suspend a ball attached to said ball suspension means for striking by a user.

14. The game system of claim 13 wherein said game structure is a tether ball having a line connected to said attaching means.

15. The game system of claim 13 wherein said ball has an aperture formed therethrough and wherein said ball suspension means extends into said ball.

16. The game system of claim 15 wherein said ball suspension means includes a linked metal chain.

17. The game system of claim 16 wherein said aperture includes a first bore that extends into said ball, said first bore having a first cross section sized to snugly receive said linked metal chain therein, and a second bore in communication with said first bore and extending through said ball to the exterior thereof, said second bore having a cross section less than the cross section of said first bore.

18. The game system of claim 17 wherein said ball suspension means includes a rope member that extends through said second base and a link of said linked chain, said rope member being formed into a knot to inhibit passage of said rope through said aperture to retain said ball thereon.

19. The game system of claim 17 wherein said first bore and said second bore are in axial alignment.

20. The game system of claim 19 wherein said ball has a diameter and wherein said first bore has an axial length that extends from the surface of said ball inwardly from about one fourth to about three fourths the diameter of said ball.

21. The game system of claim 20 wherein said axial length of said first bore is about one half the diameter of said ball.

22. The game system of claim 21 wherein said line has first adjustment means for adjusting the length of said line.

23. The game system of claim 22 wherein said first adjustment means is a turnbuckle.

24. The game system of claim 22 wherein said first adjustment means is a linked chain having a plurality of links and wherein said second securing means includes a hook sized to removably receive a selected link of said plurality of links.

25. The game system of claim 24 wherein said line has second adjustment means to adjust the length of said line.

26. The game system of claim 25 wherein said second adjustment means is a turnbuckle.

27. The game system of claim 26 wherein said linked chain of said ball suspension means has a sheath positioned thereabout.

28. The game system of claim 27 wherein a first stop is attached to said line spaced from said first upright and a second stop is attached to said line spaced from said second upright.

29. The game system of claim 28 wherein said ball transport means is a metal ring.

30. The game system of claim 29 wherein said line is diagonal.

31. A game system comprising:

a first base having a first receptacle positioned through and under a supporting surface;

a second base having a second receptacle positioned through and under a supporting surface;

a first upright removably and snugly positioned in said first receptacle to extend upwardly therefrom;

a second upright removably and snugly positioned in said second receptacle to extend upwardly therefrom;

a plurality of net-securing structures positioned along the length of said first upright and said second upright for positioning a game net for use in at least two of the games of men's volleyball, women's volleyball, badminton and lawn tennis;

a game net having a top and a bottom, said game net having:

an upper fight strap for connection to one of said net-securing structures and to said game net proximate said top, said upper right strap being formed of an inelastic material;

a lower right strap for connection to one of said net-securing structures and to the bottom of said game net, said lower right strap being formed of an elastically-deformable material;

an upper left strap for connection to one of said net-securing structures and proximate the top of said game net, said left strap having adjustment means for adjusting the length thereof between said top and said net-securing structure;

a lower left strap for connection proximate the bottom of said game net and to one of said net-securing structures, said lower left strap being formed of an elastically-deformable material.

32. A game system having:

a first upright positioned to extend upwardly from a surface, said first upright having at least two net-securing structures associated therewith and spaced from each other;

a second upright positioned to extend upwardly from a surface, said second upright having at least two net-securing structures associated therewith and spaced from each other;

a net member for positioning between said first upright and said second upright, said net member having a top and a bottom;

first securing means for securing said game net to said two net-securing structures associated with said first upright, said first securing means including an upper strap member positioned to secure the top of said net member to one of said two net-securing structures and a lower strap member to secure the bottom of said net member to the other of said two net-securing structures, one of said upper strap members and said lower strap members being made of an elastically-deformable material and the other being made of an essentially inelastically-deformable material; and second securing means for securing said game net to said two net-securing structures associated with said second upright, said second securing means including an upper strap member positioned to secure the top of said net member to one of said two net-securing structures and a lower strap member to secure the bottom of said net member to the other of said two net-securing structures, one of said upper strap member and said lower strap member being made of an elastically-deformable material and the other being made of an essentially inelastically-deformable material.

33. The game system of claim 32 wherein said upper strap of said second securing means is made of an inelastically-deformable material and includes adjustment means for adjusting the length of the strap between said net member and said second upright.

34. The game system of claim 33 wherein said upper strap of said first securing means is made of an inelastically-deformable material.

35. The game system of claim 34 wherein said upper strap and said lower strap of said first securing means each have distal ends and each have hooks connected proximate to said distal ends, and wherein said two net-securing structures associated with said first upright each include hook receiving structure for removably receiving said hooks.

36. The game system of claim 34 wherein said lower strap of said second securing means has a distal end with a hook secured proximate thereto, wherein the adjustment means of said upper strap is a plurality of hooks secured to said upper strap spaced apart and along its length, and wherein said two net-securing structures associated with said second upright are formed to removably receive said hooks.

37. A game system comprising:

a first upright positioned to extend above a surface;

a second upright positioned to extend above a surface;

a line positioned to extend between said first upright and said second upright;

first connecting means to connect said line to said first upright;

second connecting means to connect said line to said second upright;

ball transport means associated with said line to move therealong;

ball suspension means connected to said ball transport means to suspend a ball therefrom;

a ball secured to the ball suspension means; and said ball has an aperture formed therethrough and wherein said ball suspension means extends into said ball wherein said aperture includes a first bore that extends into said ball, said first bore having a first cross section sized to snugly receive said ball suspension means therein, and a second bore in communication with said first bore and extending through said ball to the exterior thereof, said second bore having a cross section less than the cross section of said first bore.

38. The game system of claim 37 wherein said ball suspension means includes a linked metal chain which is snugly received in said first bore.

39. The game system of claim 38 wherein said ball suspension means includes a rope member that is attached to said linked metal chain and extends through said second bore, said rope member being formed into a knot to inhibit passage of said rope through said second bore to retain said ball thereon.

40. The game system of claim 39 wherein said first bore and said second bore are in axial alignment.

41. The game system of claim 40 wherein said ball has a diameter and wherein said first bore has an axial length that extends from the surface of said ball inwardly from about one fourth to about three fourths the diameter of said ball.

42. The game system of claim 41 wherein said axial length of said first bore is about one half the diameter of said ball.

43. The game system of claim 42 wherein said line has first adjustment means for adjusting the length of said line.

44. The game system of claim 43 wherein said first adjustment means is a turnbuckle.

45. The game system of claim 43 wherein said first adjustment means is a linked chain having a plurality of links and wherein said second securing means includes a hook sized to removably receive a selected link of said plurality of links.

46. The game system of claim 45 wherein said line has second adjustment means to adjust the length of said line.

47. The game system of claim 46 wherein said second adjustment means is a turnbuckle.

48. The game system of claim 47 wherein said linked chain of said ball suspension means has a sheath positioned thereabout.

49. The game system of claim 48 wherein a first stop is attached to said line spaced from said first upright and a second stop is attached to said line spaced from said second upright.

50. The game system of claim 49 wherein said ball transport means is a metal ring.

51. The game system of claim 50 wherein said line is diagonal.

52. A game system comprising:

support structure to position a suspended ball for striking with a bat by a user;

ball suspension means for suspending said ball relative to said support structure;

connection means for connecting said ball suspension means to said support structure;

a ball having a first bore formed therein with a first cross-section and a second bore formed therein in communication between said first bore and the exterior of said ball, said second bore having a cross-section less than said cross-section of said first bore said ball suspension means extending into said first bore; and a rope member extending through said second bore through said ball suspension means, said rope member being formed into a knot to inhibit passage of said rope through said second bore.

53. The game system of claim 52 wherein said ball suspension means is a linked chain.

54. The game system of claim 53 wherein said chain includes a sheath positioned thereover.

* * * * *